United States Patent [19]

Amezcua

[11] 4,046,250

[45] Sept. 6, 1977

[54] PAINTING PALETTE

[76] Inventor: Saul Ortega Amezcua, Col. Condesa, Mazatlan 118 Mexico City, 11, Mexico

[21] Appl. No.: 717,577

[22] Filed: Aug. 26, 1976

[51] Int. Cl.[2] ..... B44D 3/02

[52] U.S. Cl. ..... 206/1.7; 206/813; 24/DIG. 11; 248/205 A

[58] Field of Search ..... 206/1.7, 1.8, 1.9, 224, 206/549, 486, 813; 248/205 A, 359, 360, 467, 506; 24/DIG. 11, 67 AR, 73 VA; 428/40

[56] References Cited

U.S. PATENT DOCUMENTS

| | | | |
|---|---|---|---|
| 748,026 | 12/1903 | Sussmilch | 206/1.7 |
| 1,805,520 | 5/1931 | Grumbacher | 206/1.7 |
| 1,942,287 | 1/1934 | Heitz | 206/449 |
| 2,166,616 | 7/1939 | Wallace | 206/1.7 |
| 2,170,147 | 8/1939 | Lane | 24/67 AR X |
| 3,080,997 | 3/1963 | Brown | 206/460 X |
| 3,126,666 | 3/1964 | Peterson | 248/205 A X |
| 3,654,059 | 4/1972 | Zisblatt | 206/813 X |
| 3,672,742 | 6/1972 | Barg | 206/1.7 X |
| 3,847,324 | 11/1974 | Uchanski et al. | 206/813 X |

FOREIGN PATENT DOCUMENTS

| | | | |
|---|---|---|---|
| 610,110 | 10/1948 | United Kingdom | 206/1.8 |

*Primary Examiner*—Robert S. Ward, Jr.
*Attorney, Agent, or Firm*—George J. Netter

EXEMPLARY CLAIM

The painters' palette includes a molded plastic body having an area on the bottom surface provided with adhesive for securing the palette to the surface on which it rests.

1 Claim, 3 Drawing Figures

PAINTING PALETTE

The present invention relates generally to a painting palette, and, more particularly, to an improved palette construction which may be stably and relatively immovably located on any generally horizontal or slightly elevated surface.

DESCRIPTION OF A PREFERRED EMBODIMENT

Figure 3:
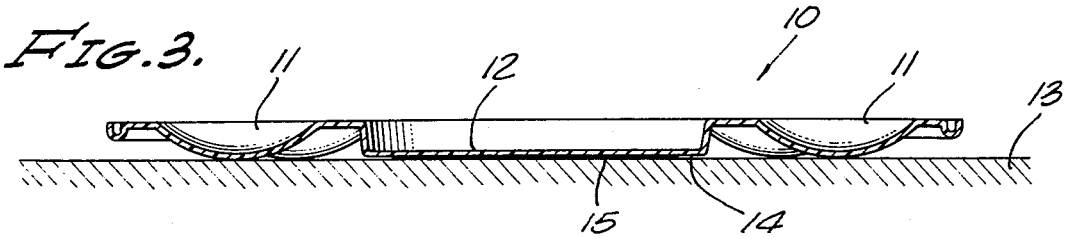
FIG. 3 is a sectional, elevational view taken along line 3—3 of FIG. 1.

With reference now to the drawing, the painting palette of this invention is enumerated generally as at 10, and is seen to consist essentially of a circular, sheetlike body having a plurality of dished-out portions or concavities 11 circumferentially arranged about a central concavity or well 12. Although other materials may be found satisfactory, the best mode of manufacture of the palette known at this time is to mold it from plastic. As can be seen best in FIG. 3, the back side of the well 12 is flat and lies in the same plane with the back surfaces of the concavities 11, so that when the palette rests on a flat surface 12, it is a stable arrangement not subject to rocking or tilting.

It is contemplated that the concavities will each accommodate a quantity of paint for use by the artist.

Figure 1:
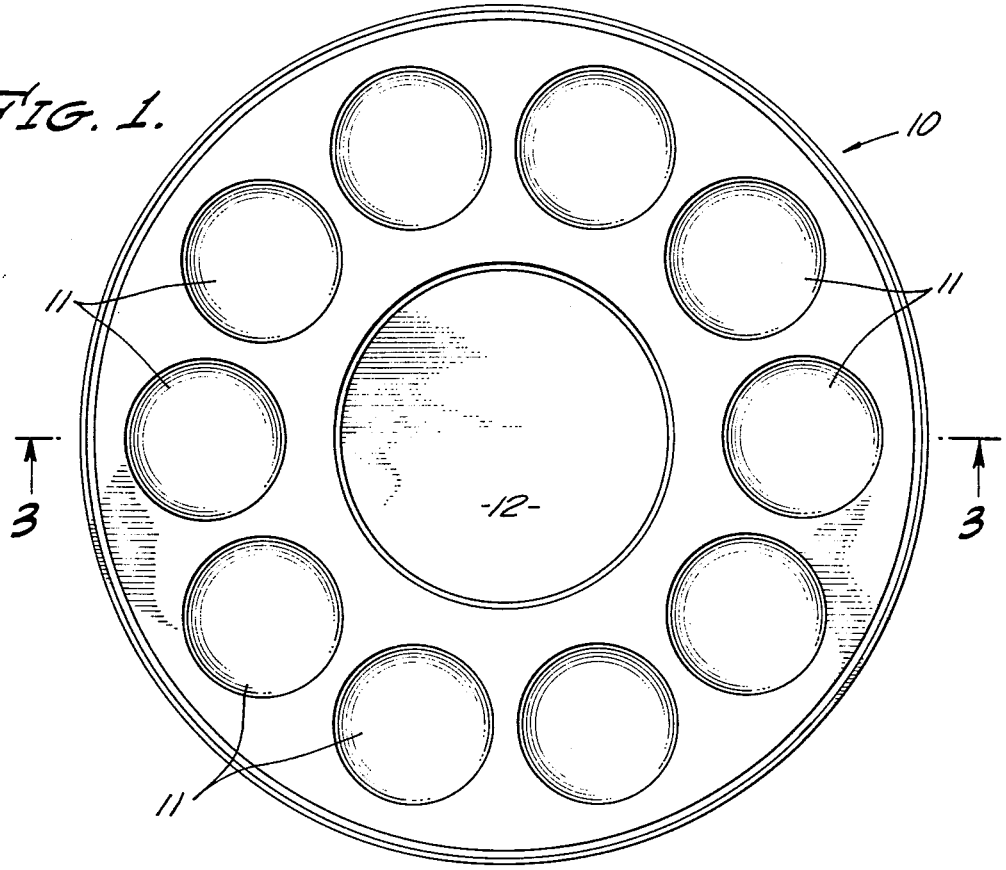
FIG. 1 is a top plan view of the palette of this invention.
Figure 2:
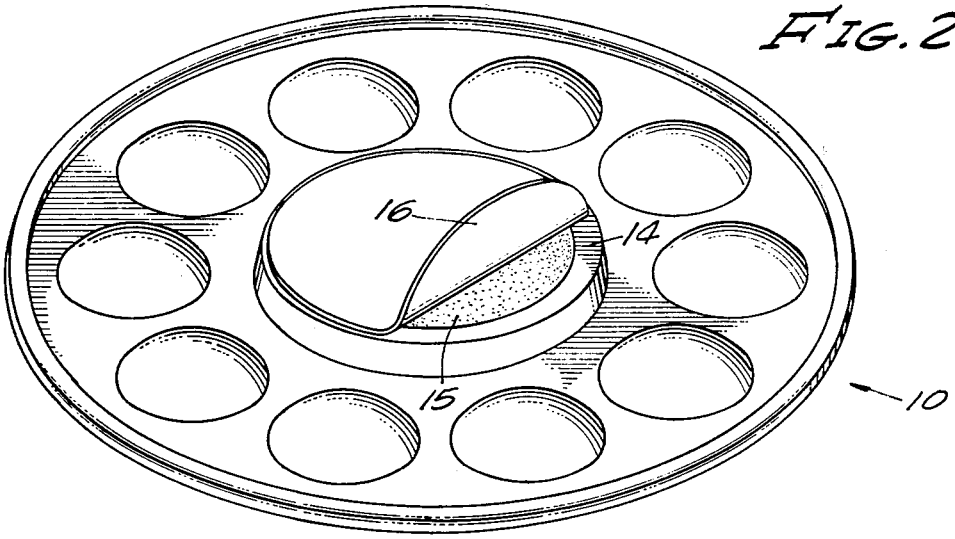
FIG. 2 is a perspective view of the palette under surface.

With reference now particularly to FIG. 2, the lower flat surface 12 is provided with a quantity of cementitious material 15, over which a cover 16 is removably received. The cover may be of either plastic or paper, and, in use, is peeled off to expose the adhesive 15 such that when the palette is placed on a surface (e.g., surface

13), the adhesive will secure the palette is place and prevent its accidental dislodgement.

Optionally, a plurality of covers 16 may be provided, with adhesive on both sides, so that when the adhesive on the outermost cover loses its adhesive quality, the cover may be peeled off and the adhesive of the cover immediately below will be exposed for use.

There is provided in accordance with this invention an artist's painting palette which is inexpensive to manufacture and may be simple disposed of after use. The palette may be rested on any convenient surface (either horizontal or angularly disposed) and it will maintain a stable, substantially fixed, relation throughout use. However, if the artist decides to move the palette, it is easily disengaged from the supporting surface for replacement elsewhere.

I claim:

1. A painting palette, comprising:

a molded plastic member having a plurality of concavities on one surface for receiving painting materials therein and corresponding convexities on the opposite side, said member further including a well located among the concavities with a convex portion thereof on the same side as said first mentioned convexities, with the outermost extensions of said convexities and well convex portion lying in the same plane;

a second surface of said member serving as a supportive base;

a quantity of adhesive on at least a part of said second surface; and a plurality of sheetlike covers having adhesive on their major surfaces and adhered together to form a stack thereof on the member second surface, whereby a corresponding plurality of adhesive covers are provided for securingly mounting the member to another surface by peeling off the outermost covers one at a time.

* * * * *

UNITED STATES PATENT AND TRADEMARK OFFICE

CERTIFICATE OF CORRECTION

PATENT NO. : 4,046,250

DATED : September 6, 1977

INVENTOR(S) : Saul Ortega Amezcua

It is certified that error appears in the above-identified patent and that said Letters Patent are hereby corrected as shown below:

Cover sheet: Delete "PAINTING PALETTE" and insert therefor --DISPOSABLE PAINTING PALETTE--;

Column 1, line 2, delete "PAINTING PALETTE" and insert therefore --DISPOSABLE PAINTING PALETTE--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*